US009500025B2

(12) United States Patent
Genzel

(10) Patent No.: US 9,500,025 B2
(45) Date of Patent: Nov. 22, 2016

(54) BREAKAWAY CORD CONNECTOR

(71) Applicant: THE SHADE STORE, LLC, Port Chester, NY (US)

(72) Inventor: Jacob Genzel, Brookville, NY (US)

( * ) Notice: Subject to any disclaimer, the term of this patent is extended or adjusted under 35 U.S.C. 154(b) by 158 days.

(21) Appl. No.: 14/335,150

(22) Filed: Jul. 18, 2014

(65) Prior Publication Data

US 2016/0017655 A1 Jan. 21, 2016

(51) Int. Cl.
*E06B 9/326* (2006.01)

(52) U.S. Cl.
CPC ..... *E06B 9/326* (2013.01); *E06B 2009/3265* (2013.01)

(58) Field of Classification Search
CPC ..... E06B 9/326; E06B 2009/3265; Y10T 24/32; Y10T 24/3913; Y10T 24/39; Y10T 24/3982
USPC ..... 24/303
See application file for complete search history.

(56) References Cited

U.S. PATENT DOCUMENTS 3,111,736 A * 11/1963 Budreck ..... A44B 15/002 24/303
4,909,298 A * 3/1990 Langhart ..... A47H 11/02 160/178.1 R
5,518,057 A * 5/1996 Huang ..... E06B 9/326 160/178.1 R
5,542,462 A 8/1996 Elsenheimer et al.
5,579,819 A * 12/1996 Hung ..... E06B 9/326 16/442
5,715,884 A * 2/1998 Cotten ..... E06B 9/326 24/115 A
5,906,233 A * 5/1999 May ..... E06B 9/326 160/178.1 R
6,044,523 A * 4/2000 Ortega ..... E06B 9/326 16/428
7,156,338 B2 1/2007 Schartner
7,311,132 B2 12/2007 Corey et al.
7,383,871 B2 * 6/2008 Osinga ..... E06B 9/326 160/178.1 R
7,587,794 B2 * 9/2009 Lin ..... E06B 9/326 160/178.1 R
8,104,146 B2 * 1/2012 Wen ..... E06B 9/326 160/178.1 R
8,215,368 B2 7/2012 Ellis
2005/0087312 A1 * 4/2005 Nien ..... E06B 9/326 160/178.1 R
2005/0199353 A1 * 9/2005 Corey ..... E06B 9/32 160/178.1 R (Continued)

FOREIGN PATENT DOCUMENTS

CA 2 591 178 A1 12/2008
CA 2 672 362 A1 1/2011

(Continued)

OTHER PUBLICATIONS

Breakaway Cord Connectors, Conservatory Blinds Limited, UK, www.conservatoryblinds.co.uk, Jan. 31, 1995.

(Continued)

*Primary Examiner* — David E Sosnowski
*Assistant Examiner* — Jason W San
(74) *Attorney, Agent, or Firm* — Gottlieb, Rackman & Reisman P.C.

(57) ABSTRACT

A breakaway cord connector or releasably connecting cords associated with a window covering that includes a plurality of housing members that each have a curved vertical sidewall, a top wall extending from the curved vertical sidewall, a base extending from the curved vertical sidewall, a protrusion extending from the curved vertical sidewall between the top wall and the base and magnets fixed to the protrusion. The housing members are configured to be releasably connectable to each other by the connecting elements to prevent an individual that may become tangled in cords associated from suffocating.

18 Claims, 6 Drawing Sheets

(56) References Cited

U.S. PATENT DOCUMENTS

| | | | | |
|---|---|---|---|---|
| 2007/0056320 | A1* | 3/2007 | Azar | A44C 3/007 63/3 |
| 2007/0125140 | A1* | 6/2007 | Ho | E05B 73/0017 70/276 |
| 2007/0180858 | A1* | 8/2007 | Wiseman | A44C 5/102 63/4 |
| 2013/0111710 | A1* | 5/2013 | Hunts | H01F 7/0242 24/303 |
| 2013/0227821 | A1* | 9/2013 | Chen | E06B 9/326 24/129 R |
| 2013/0312223 | A1* | 11/2013 | Martinez | E06B 9/326 16/428 |
| 2014/0157553 | A1* | 6/2014 | Liu | E06B 9/326 24/128 |
| 2014/0208544 | A1* | 7/2014 | Martinez | E06B 9/326 16/428 |
| 2015/0074954 | A1* | 3/2015 | Pruitt | A44C 5/2071 24/303 |
| 2015/0152981 | A1* | 6/2015 | Goodall | A44B 99/00 24/303 |

FOREIGN PATENT DOCUMENTS

| | | |
|---|---|---|
| ES | 1073373 U | 12/2010 |
| UA | 2479523 A | 10/2011 |

OTHER PUBLICATIONS

Cellular SlumberShade, www.selectblinds.com by selectshops, Jan. 6, 2011.

'B' System Blinds (Manual Lower Side Control), Thermoseal Group, UK, www.thermosealgroup.com, May 3, 2014.

Window Blind Safety, Wood Venetian Blinds, www.windowblindsafery.ie, May 3, 2014.

* cited by examiner

FIG. 1
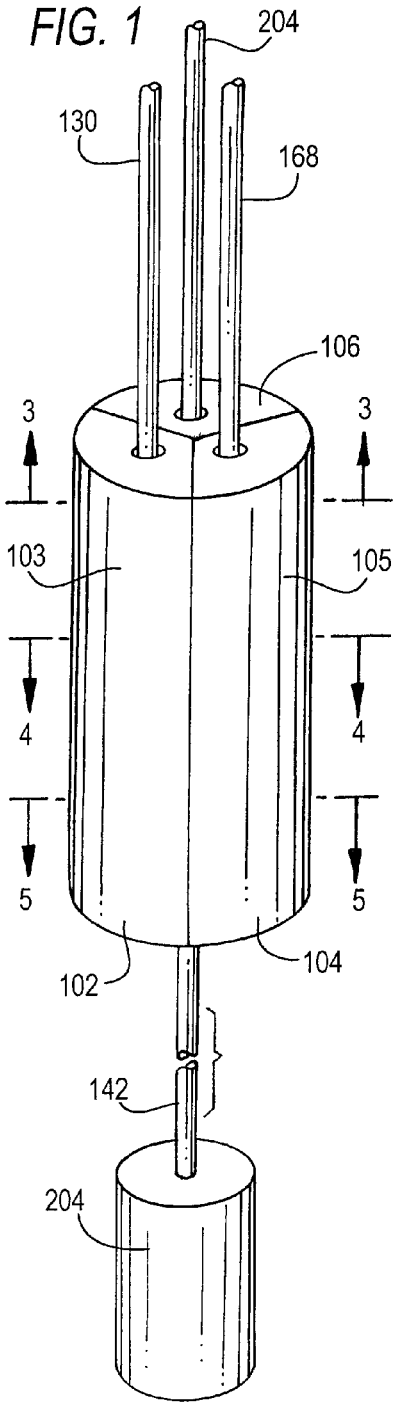
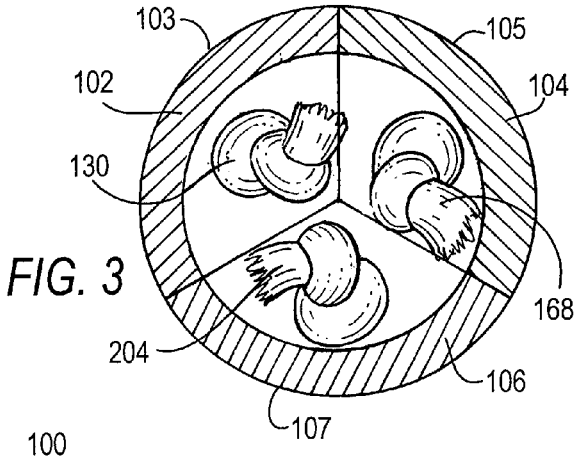
FIG. 3
100
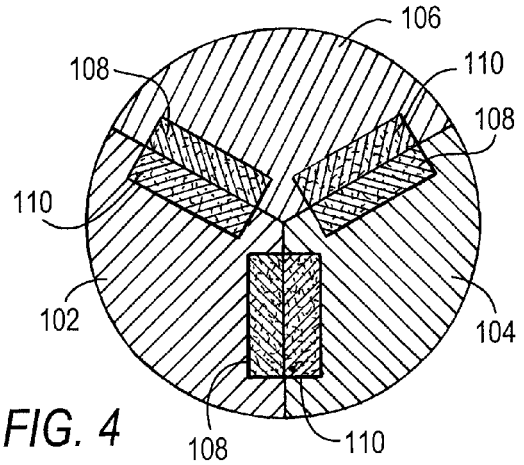
FIG. 4
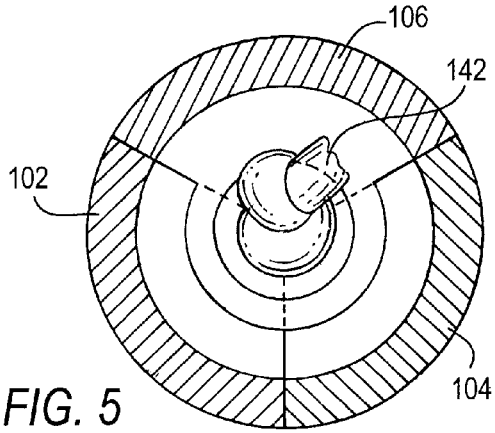
FIG. 5

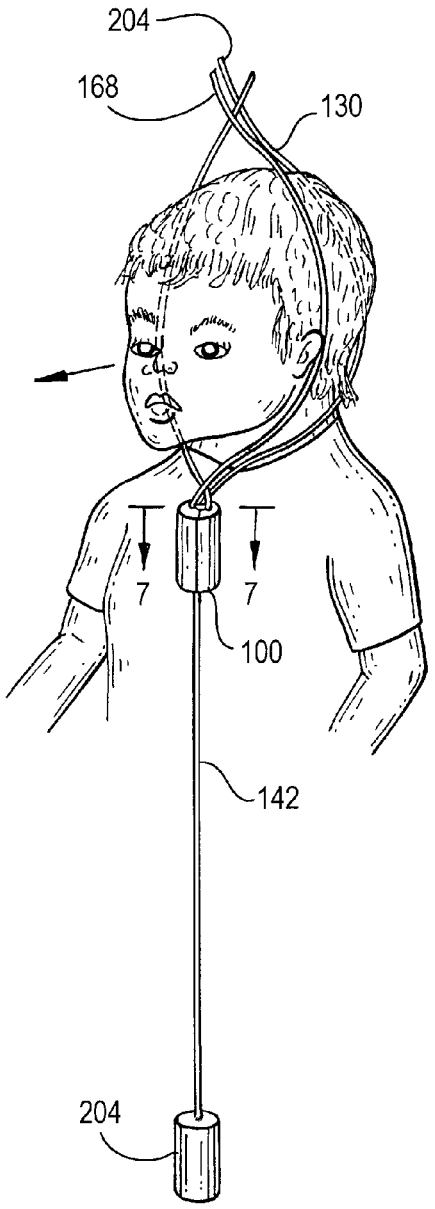
FIG. 6
FIG. 7
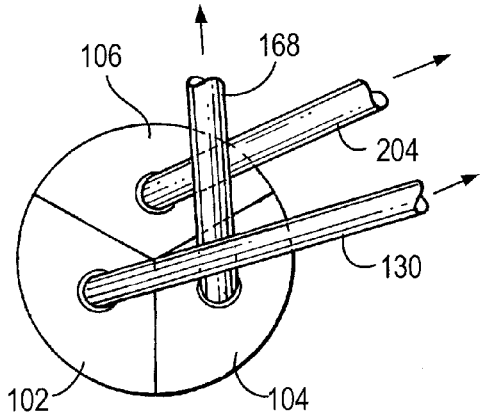

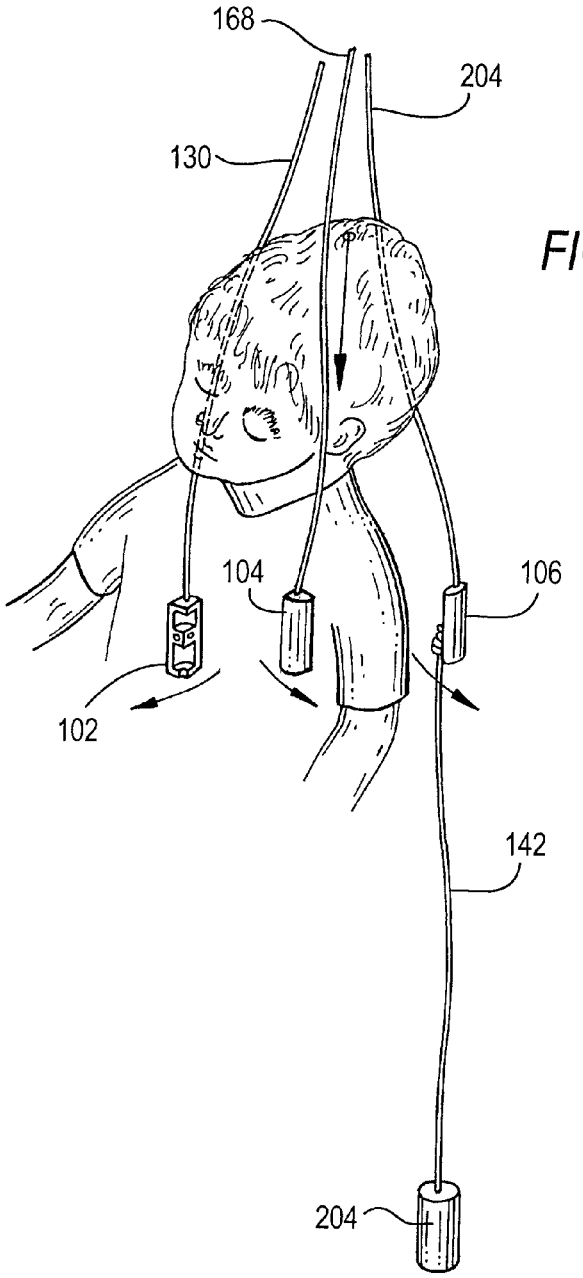
FIG. 8
FIG. 9
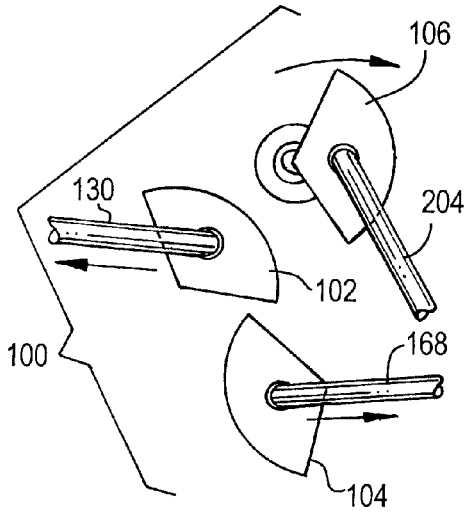

BREAKAWAY CORD CONNECTOR

FIELD OF THE INVENTION

The present invention relates generally to a cord connector and more particularly to a cord connector that includes a plurality of housing members that are releasably fastenable to each other by a magnetic connection.

BACKGROUND OF THE INVENTION

Cord connectors associated with window coverings including blinds, shades and the like that include a breakaway feature are known. Typically, cord connectors are designed to bundle a plurality of cords together to provide a more aesthetically pleasing appearance and, in many situations, to aid in simplifying the use of the cords by requiring the operation of only a single cord. However, several deaths each year are attributed to strangulation by loops formed from cords associated with window coverings. The breakaway feature is intended to prevent an individual, particularly a child that may become tangled in the plurality of cords associated with a cord connector, from suffocating. That is, when a force above a threshold level is applied to the cord connector, the housing elements of the connector will separate from each other.

SUMMARY OF THE INVENTION

The present invention is directed broadly to a breakaway cord connector for three or more cords that includes a plurality of magnets that are releasable upon an application of force. In an embodiment, a breakaway cord connector for releasably connecting cords associated with a window covering comprises three substantially similar housing members including a first housing member, a second housing member and a third housing member that each include a curved external sidewall, a top wall extending from the curved external sidewall that includes a through hole, a base extending from the curved external sidewall, a protrusion extending from the curved external sidewall between the top wall and the base and magnets fixed at the protrusion. Cords are connectable to each of the housing members. These cords include a first cord being connectable to the first housing member, a second cord being connectable to the second housing member and a third cord being connectable to the third housing member. The housing members are configured to be releasably connectable to each other such that the magnets of the housing members are aligned with each other in an assembled state.

In an embodiment, at least two of the housing members have identical features. In an embodiment, each of the housing members further include a first sidewall and a second sidewall at that converge at a 120° angles.

In an embodiment, the protrusion of each of the first, second and third housing members includes a first vertical sidewall with a first circular recess formed therein and a second vertical sidewall with a second circular recess formed therein.

In an embodiment, each of the first, second and third housing members includes a first magnet that is arranged within the first recess and a second magnet that is arranged within the second recess, one of the magnets having a positive polarity and the other of the magnets having a negative polarity. In an embodiment, the magnets of the first, second and third housing member are aligned in an assembled state such that a positive magnet of each of the first, second and third housing members is aligned with a negative magnet of each of the first, second and third housing members to releasably fasten the housing members to each other.

In an embodiment, the base of the third housing member is offset from a distal end of the curved vertical sidewall toward the top wall. In an embodiment, the base of the third housing member includes a semicircular protrusion extending outwardly therefrom and away from the curved vertical sidewall. In an embodiment, the base of the first housing member and the base of the second housing member are configured and adapted to be contactable with an outer surface of the base of the third housing member and an inner surface of the curved vertical sidewall of the third housing member.

In an embodiment, the amount of force required to release the connecting elements from each other is less than 3 pounds.

In an embodiment, the first housing member, the second housing member and the third housing member in combination form a cylindrical structure.

In an embodiment, the housing members are comprised of plastic, metal, composite or wood.

In an embodiment, a breakaway cord connector for releasably connecting cords associated with a window covering comprises four substantially similar housing members including a first housing member, a second housing member, a third housing member and a fourth housing member. The housing members each including a curved external sidewall, a top wall extending from the curved external sidewall that includes a through hole, a base extending from the curved external sidewall, a protrusion extending from the curved external sidewall between the top wall and the base and magnets fixed at the protrusion. The breakaway connector also comprises four cords including a first cord being connected to the first housing member, a second cord being connected to the second housing member, a third cord being connected to the third housing member, and a fourth cord being connected to the fourth housing member. The housing members are configured to be releasably connectable to each other such that the magnets of the housing members are aligned with each other in an assembled state.

In an embodiment, at least three of the housing members have identical features. In an embodiment, each of the housing members further include a first sidewall and a second sidewall at that converge at a 90° angle. In an embodiment, the protrusion of each of the first, second, third and fourth housing members includes a first vertical sidewall with a first circular recess formed therein and a second vertical sidewall with a second circular recess formed therein. In an embodiment, each of the first, second, third and fourth housing members each include a first magnet that is arranged within the first recess and a second magnet that is arranged within the second recess, one of the magnets having a positive polarity and the other of the magnets having a negative polarity.

In an embodiment, the magnets of the first, second, third and fourth housing member are aligned in an assembled state such that a positive magnet of each of the first, second, third and fourth housing members is aligned with a negative magnet of each of the first, second, third and fourth housing members to releasably fasten the housing members to each other.

In an embodiment, the base of the third housing member is offset from a distal end of the curved vertical sidewall toward the top wall.

In an embodiment, the base of the fourth housing member includes a semicircular protrusion extending outwardly therefrom and away from the curved vertical sidewall.

In an embodiment, the base of the first housing member, the base of the second housing member and the base of the third housing member are configured and adapted to be contactable with an outer surface of the base of the fourth housing member and an inner surface of the curved vertical sidewall of the fourth housing member.

In an embodiment, the amount of force required to release the connecting elements from each other is less than 3 pounds.

In an embodiment, the first housing member, the second housing member, the third housing member and the fourth housing member in combination form a cylindrical structure.

BRIEF DESCRIPTION OF THE DRAWINGS

FIG. 1 is a perspective view of a first embodiment of a breakaway cord connector of the present invention;

FIG. 3 is a sectional view of the breakaway cord connector taken along line 3-3 of FIG. 1;

FIG. 4 is a sectional view of the breakaway cord connector taken along line 4-4 of FIG. 1;

FIG. 5 is a sectional view of the breakaway cord connector taken along line 5-5 of FIG. 1;

FIG. 6 is a view illustrating a child tangled in cords associated with the breakaway cord connector of FIG. 1;

FIG. 7 is a sectional view of the breakaway cord connector of FIG. 1 taken along line 7-7 of FIG. 6 showing cords tangled amongst each other;

FIG. 8 is a view illustrating the breakaway cord connector of FIG. 1 separated by force applied by a child tangled between the cords;

FIG. 9 is a top view of the breakaway cord connector of FIG. 1 in a separated state due to a force applied thereon;

DETAILED DESCRIPTION OF EMBODIMENTS OF THE INVENTION

Figure 2:
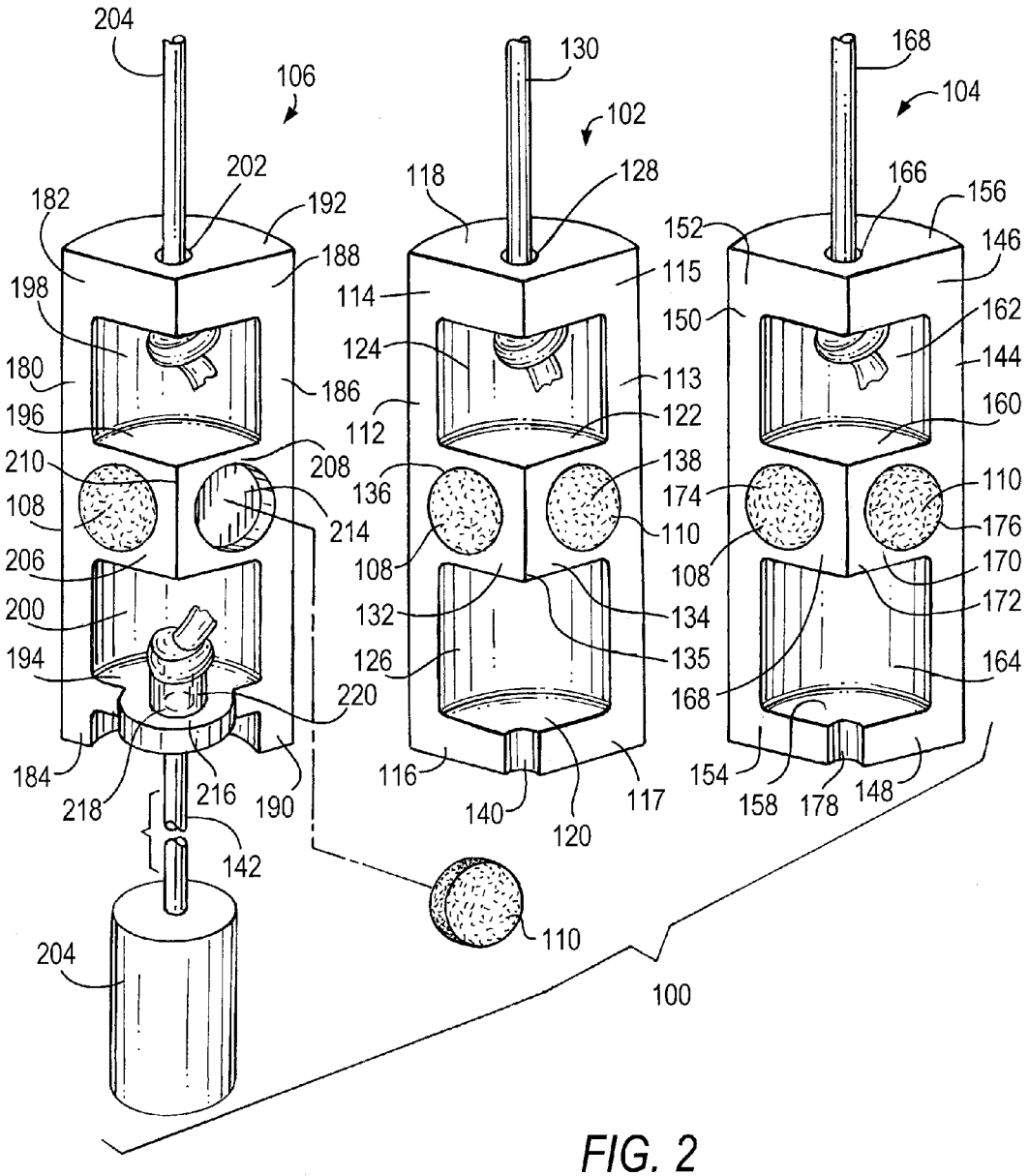
FIG. 2 is an exploded view of the breakaway cord connector of FIG. 1.

FIGS. 1-9 illustrate an embodiment of a breakaway cord connector, which is designated hereinafter by reference numeral 100. The breakaway cord connector 100 includes a first housing member 102, a second housing member 104 and a third housing member 106, that are releasably connectable to each other by magnets 108, 110. As shown in FIG. 1, the housing members 102, 104, 106 each include a curved vertical periphery 103, 105, 107, respectively. Independently each housing member 102, 104, 106 substantially forms a "pie shape" and together the housing members 102, 104, 106 form a cylindrical or tubular structure.

FIG. 2 illustrates an exploded view of the breakaway cord connector 100. The housing member 102, 104, 106 are designed such that they can "penetrate" or be nested amongst each other. The connector 100 is designed such that it can be located far away from a child's reach if desired. With a two-part connector, the connector would have to be located much lower for functional operation.

As shown in FIG. 2, the first housing member 102 includes a first vertical sidewall 112 that has an upper end 114 and a lower end 116 and a second vertical sidewall 113 that has an upper end 115 and a lower end 117. The sidewalls 112 and 113 meet at an angle of about 120°. A horizontal flat top wall 118 extends between the upper ends 114, 115 of the vertical sidewalls 112, 113, a horizontal flat base wall 120 extends between the lower ends 116, 117 of the vertical sidewalls 112, 113 and a central protrusion 122 extends from the vertical sidewall 103 centrally between the top wall 118 and the base wall 120. An upper curved cavity 124 is formed between the top horizontal wall 118 and the central protrusion 122 and a lower curved cavity 126 is formed between the central protrusion 122 and the base wall 120. The top horizontal wall 118 includes an opening 128 that is substantially centrally located through which a first cord 130 can extend. The upper and lower cavities 124, 126 are large enough to each receive the first cord 130 that can be connected to the housing member 102 by knotting the cord 130. The central protrusion 122 includes a first vertical sidewall 132 and a second vertical sidewall 134 that are orientated such that they come to a central apex 135, and they meet at a 120° angle. A first circular depression 136 extends centrally into the first vertical sidewall 132 to house one of the magnets 108, 110 and a second circular depression 138 extends centrally into the second vertical sidewall 134 to house the other of the magnets 108, 110. The magnets 108, 110 can be press fit and/or glued into the depressions 136, 138 such that the connecting elements 108, 110 are flush with the surface of the side walls 132, 134. The horizontal base 122 includes a semi-circular recess 140 located between the lower ends 116, 117 of the vertical sidewalls 112, 113 in which a second cord 142 can be arranged.

The second housing member 104 is similar to the first housing member 102. Like the first housing member 102, the second housing member 104 includes a first vertical sidewall 144 that has an upper end 146 and a lower end 148 and a second vertical sidewall 150 that has an upper end 152 and a lower end 154. The sidewalls 144 and 150 meet at an angle of about 120°. A horizontal flat top wall 156 extends between the upper ends 146, 152 of the vertical sidewalls 144, 150, a horizontal flat base wall 158 extends between the lower ends 148, 154 of the vertical sidewalls 144, 150 and a central protrusion 160 extends from the vertical sidewall 105 centrally between the top wall 156 and the base wall 158. An upper curved cavity 162 is formed between the top horizontal wall 156 and the central protrusion 160 and a lower curved cavity 164 is formed between the central protrusion 160 and the base wall 158. The top horizontal wall 156 includes an opening 166 that is substantially centrally located through which a third cord 168 can extend. The upper and lower cavities 162, 164 are large enough to each receive the third cord 168 that can be connected to the housing member 104 by knotting the cord 168. The central protrusion 160 includes a first vertical sidewall 168 and a second vertical sidewall 170 that are orientated such that they come to a central apex 172, and they meet at an angle of about 120°. A first circular depression 174 extends centrally into the first vertical sidewall 168 to house one of the connecting elements 108, 110 and a second circular depression 176 extends centrally into the second vertical sidewall 170 to house the other of the magnets 108, 110. The magnets 108, 110 can be press fit and/or glued into the depressions 174, 176 such that the magnets 108, 110 are flush with the surface of the side walls 168, 170. The horizontal base 158 includes a semi-circular recess 178 located between the lower ends 148, 154 of the vertical sidewalls 144, 150 in which a second cord 142 can be arranged.

The third housing member 106 includes a first vertical sidewall 180 that has an upper end 182 and a lower end 184 and a second vertical sidewall 186 that has an upper end 188 and a lower end 190. The sidewalls 180 and 186 meet at an angle of about 120°. A horizontal flat top wall 192 extends between the upper ends 182, 188 of the vertical sidewalls 180, 186, a horizontal flat base wall 194 extends near the lower ends 148, 154 of the vertical sidewalls 180, 186, offset from the lower ends 184, 190 toward the upper ends 182, 188 and a central protrusion 196 extends from the vertical sidewall 107 centrally between the top wall 192 and the base wall 194. An upper curved cavity 198 is formed between the top horizontal wall 192 and the central protrusion 196 and a lower curved cavity 200 is formed between the central protrusion 196 and the base wall 194. The top horizontal wall 192 includes an opening 202 that is substantially centrally located through which a fourth cord 204 can extend. The upper and lower cavities 198, 200 are large enough to each receive the fourth cord 204 that can be connected to the housing member 106 by knotting the cord 204. The central protrusion 196 includes a first vertical sidewall 206 and a second vertical sidewall 208 that are orientated such that they come to a central apex 210, and they meet at a 120° angle. A first circular depression 212 extends centrally into the first vertical sidewall 206 to house one of the connecting elements 108, 110 and a second circular depression 214 extends centrally into the second vertical sidewall 208 to house the other of the connecting elements 108, 110. The magnets 108, 110 can be press fit into the depressions 212, 214 such that the magnets 108, 110 are flush with the surface of the side walls 206, 208. The horizontal base 194 includes a substantially semicircular protrusion 216 in which an opening 218 is formed. The second cord 142 can be arranged through the opening 218 and a collar 220 can contact the horizontal base to space the cord 142 from directly contacting a surface of the base. Extending from the cord 142 at an end of the second cord 142 not connected to the third housing member 106 is a cylindrical housing 222. The cylindrical housing 222 includes a pot-shaped opening 224 extending from a first end and a through hole 226 formed in a second end. The cord 142 extends through the hole 226 and is fastenable, for example, by knotting the cord 142 within the pot-shaped opening 224.

In an assembled state, the bases of the first and second housing members 102, 104 rest on the substantially semicircular protrusion 216 of the third housing member 106. The substantially semicircular protrusion 216 aids to substantially prevent vertical movement of the first and second housing members 102, 104 in relation to the third housing member 106 such that the housing members 102, 104, 106 nest amongst each other. The housing members 102, 104, 106 can be made of any material that is known or may become known, including, but not limited to plastics, metals, composites and wood.

FIG. 3 is a sectional view taken along line 3-3 of FIG. 1 illustrating the housing members 102, 104, 106 in an assembled state with the cords 130, 168, 204 fastened thereto. As shown, the cords 130, 168, 204 are tied in a knot to secure the cords 130, 168, 204 to the housing members 102, 104, 106. However, the cords 130, 168, 204 can be fastened to the housing elements 102, 104, 106 by any means that are known or may become known.

FIG. 4 is a sectional view taken along line 4-4 of FIG. 1 illustrating the magnets 108, 110 arranged in each of the housing elements 102, 104, 106 and releasably connecting each of the housing elements 102, 104, 106 to each other by aligning a positive magnet fixed in one of the housing elements 102, 104, 106 with a negative magnet fixed in another of the housing elements 102, 104, 106. When the housing elements 102, 104, 106 are fastened to each other, the magnets 108, 110 together form circle of magnets about the connector 100. Thus, the housing members 102, 104, 106 are aligned in a connected state. That is, when the housing elements 102, 104, 106 are fastened to each other, the magnets 108, 110 together form circle of magnets about the connector 100.

FIG. 5 is a sectional view of the connector 100 taken along line 5-5 of FIG. 1 showing the cord 142 fastened thereto.

FIG. 6 illustrates a child tangled between the cords 130, 168, 204 associated with the connector 100 in an assembled stated, prior to the connector 100 being separated to prevent possible suffocation and/or strangulation of the child. FIG. 7 is a top view of the breakaway cord connector 100 as shown in FIG. 6 with the cords 130, 168, 204 in a tangled and twisted state.

As shown in FIGS. 8 and 9, when a force is applied to the cord connector 100, the housing members 102, 104, 106 separate from each other. In an embodiment, the force required for the housing members 102, 104, 106 to separate from each other is about less than three pounds. However, magnet polarization can be adjusted to meet and/or exceed safety standards. In a separated state, the housing members 102, 104, 106 remain suspended by the cords 130, 168, 204, respectively, and do not fall to the ground, thus preventing a potentially hazardous condition from occurring (e.g., a person could slip on the housing members 102, 104, 106 or the housing members 102, 104, 106 could create a potential choking risk for children and pets).

Figure 10:
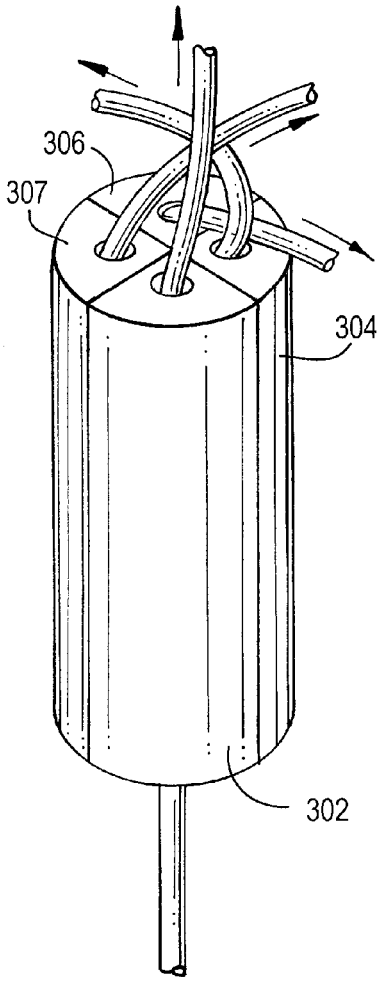
FIG. 10 is a perspective view of a second embodiment of a breakaway cord connector of the present invention.
Figure 12:
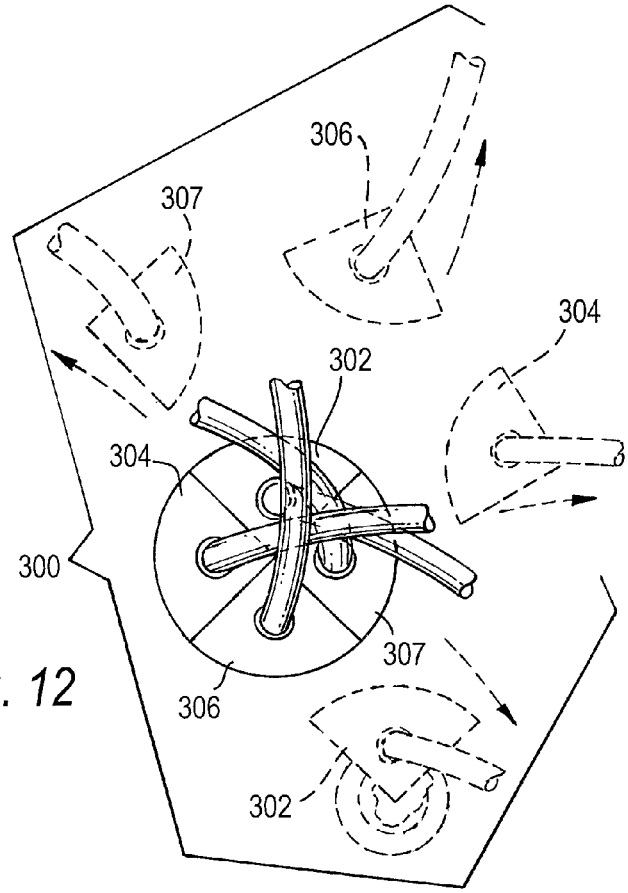
FIG. 12 is a top view of the breakaway cord connector of FIG. 10.
Figure 11:
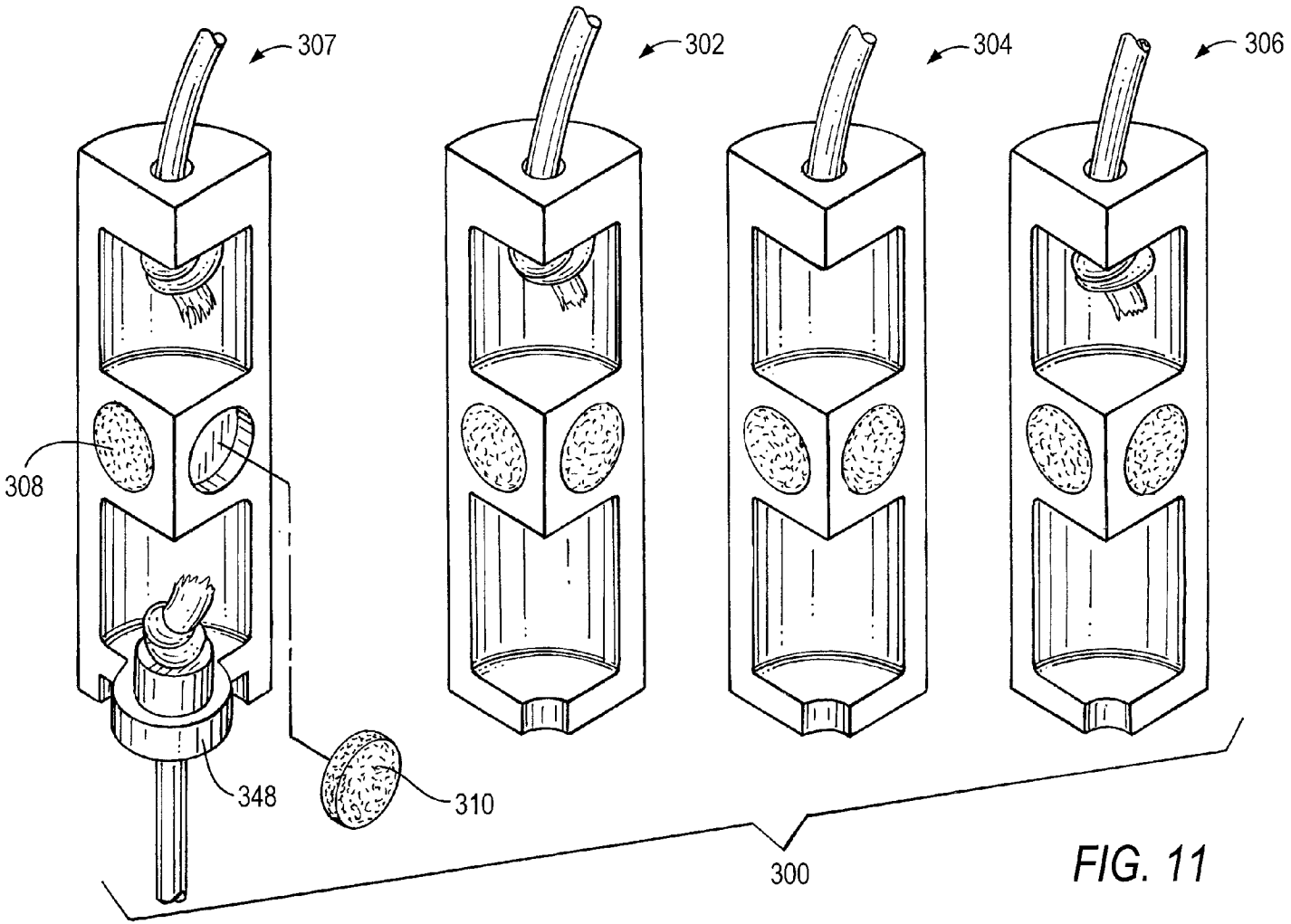
FIG. 11 is an exploded view of the breakaway cord connector of FIG. 10.

FIGS. 10-12 illustrate a second embodiment of a breakaway cord connector 300. The breakaway cord connector 300 differs from connector 100 in that the connector 300 includes four housing members 302, 304, 306, 307. The housing members 302, 304, 306, 307 each comprise an equal portion of the connector 300. The housing members 302, 304 and 306 contain similar features as those associated with housing members 102 and 104 and housing member 307 includes similar features to those associated with housing member 106. As such, each of the housing members 302, 304, 306 and 307 include magnets 308, 310 fixed thereto, allowing the housing members 302, 304, 306 and 307 to be releasably connectable to each other. In an assembled state, with the housing members 302, 304 and 306 are arranged such that they each rest on the substantially semicircular protrusion 348 of the fourth housing member 307.

Although embodiments herein depict embodiments of breakaway cord connectors that include three and four housing members, as will be recognized by a person of ordinary skill in the art, any number of housing members can be combined to form the breakaway cord connector for any number of cords. Additionally, each housing member can be formed of any shape and/or size that is known or may later become known.

Further, the connectors 100, 300 are believed to be in compliance with the standards set forth in the American National Standard for Safety of Corded Window Covering Products, ANSI/WCMA A100.1-2012 (Approved American National Standard/Window Covering Manufacturers Association, Incorporated). The document outlines the requirements for products, including breakaway cord connectors to encourage the development of devices and methods that further improve safety of window covering products. The test procedure for cord release and cord shear can be found in Appendix B of the standards.

The foregoing description and accompanying drawings illustrate the principles, exemplary embodiments, and modes of operation of the invention. However, the invention should not be construed as being limited to the particular embodiments discussed above. Additional variations of the embodiments discussed above will be appreciated by those skilled in the art and the above-described embodiments should be regarded as illustrative rather than restrictive. Accordingly, it should be appreciated that variations to those embodiments can be made by those skilled in the art without departing from the scope of the invention.

What is claimed is:

1. A breakaway cord connector for releasably connecting cords associated with a window covering, comprising:

a plurality of cords associated with the connector; and three housing members including a first housing member, a second housing member and a third housing member, the housing members each including a curved external sidewall, a top wall extending in a first direction from the curved external sidewall and including a through hole, a base, spaced from the top wall and extending in the first direction from the curved external sidewall, a protrusion extending in the first direction from the curved external sidewall between the top wall and the base and including a first vertical sidewall extending outwardly in a second direction with a first recess formed therein and a second vertical sidewall extending outwardly in a third direction with a second recess formed therein and a first magnet fixed within the first recess and a second magnet fixed within the second recess, one of the first magnet and the second magnet having a positive polarity and the other of the first magnet and the second magnet having a negative polarity, one of the cords extending through the through hole in each of the housing members, connecting a respective one of the cords to a respective one of the housing members;

wherein the housing members are configured to be releasably connectable to each other such that the magnets of the housing members are aligned with each other in an assembled state, and whereby when an object becomes entangled among the cords, outward pressure applied on the cords will cause the magnets and in turn the housing members to separate from each other without tangling.

2. The breakaway cord connector of claim 1, wherein each of the housing members further include a first sidewall and a second sidewall at that converge at a 120° angles.

3. The breakaway cord connector of claim 1, wherein the magnets of the first, second and third housing member are aligned in an assembled state forming a circle of magnets such that a positive magnet of each of the first, second and third housing members is aligned with a negative magnet of each of the first, second and third housing members to releasably fasten the housing members to each other.

4. The breakaway cord connector of claim 1, wherein the base of the third housing member is offset from a distal end of the curved vertical sidewall toward the top wall.

5. The breakaway cord connector of claim 4, wherein the base of the third housing member includes a semicircular protrusion extending outwardly therefrom and away from the curved vertical sidewall.

6. The breakaway cord connector of claim 5, wherein the base of the first housing member and the base of the second housing member are configured and adapted to be contactable with an outer surface of the base of the third housing member and an inner surface of the curved vertical sidewall of the third housing member.

7. The breakaway cord connector of claim 1, wherein the amount of force required to separate the housing members from each other is about 3 pounds.

8. The breakaway cord connector of claim 1, wherein the first housing member, the second housing member and the third housing member in combination form a cylindrical structure.

9. A breakaway cord connector for releasably connecting cords associated with a window covering, comprising:

a plurality of cords associated with the connector; and four housing members including a first housing member, a second housing member, a third housing member and a fourth housing member, the housing members each including a curved external sidewall, a top wall extending in a first direction from the curved external sidewall and including a through hole, a base extending from the curved external sidewall in the first direction, a protrusion extending from the curved external sidewall in the first direction, between the top wall and the base and including a first vertical sidewall extending outwardly in a second direction with a first recess formed therein and a second vertical sidewall extending outwardly in a third direction with a second recess formed therein and a first magnet fixed within the first recess and a second magnet fixed within the second recess, one of the first magnet and the second magnet having a positive polarity and the other of the first magnet and the second magnet having a negative polarity, one of the cords extending through the through hole in each of the housing members, connecting a respective one of the cords to a respective one of the housing members, wherein the housing members are configured to be releasably connectable to each other such that the magnets of the housing members are aligned with each other in an assembled state, and whereby when an object becomes entangled among the cords, outward pressure applied on the cords will cause the magnets and in turn the housing members to separate from each other without tangling.

10. The breakaway cord connector of claim 9, wherein each of the housing members further include a first sidewall and a second sidewall at that converge at about a 90° angle.

11. The breakaway cord connector of claim 10, wherein the magnets of the first, second, third and fourth housing member are aligned in an assembled state forming a circle of magnets such that a positive magnet of each of the first, second, third and fourth housing members is aligned with a negative magnet of each of the first, second, third and fourth housing members to releasably fasten the housing members to each other.

12. The breakaway cord connector of claim 9, wherein the base of the third housing member is offset from a distal end of the curved vertical sidewall toward the top wall.

13. The breakaway cord connector of claim 12, wherein the base of the fourth housing member includes a semicircular protrusion extending outwardly therefrom and away from the curved vertical sidewall.

14. The breakaway cord connector of claim 9, wherein the base of the first housing member, the base of the second housing member and the base of the third housing member are configured and adapted to be contactable with an outer surface of the base of the fourth housing member and an inner surface of the curved vertical sidewall of the fourth housing member.

15. The breakaway cord connector of claim 9, wherein the amount of force required to separate the housing members from each other is about 3 pounds.

16. The breakaway cord connector of claim 9, wherein the first housing member, the second housing member, the third housing member and the fourth housing member in combination form a cylindrical structure.

17. The breakaway cord connector of claim 1, wherein the magnets each include at least one substantially flat surface with the substantially flat surface of the first magnet and the substantially flat surface of the second magnet being releasably connectable to each other in the assembled state.

18. The breakaway cord connector of claim 9, wherein the magnets each include at least one substantially flat surface with the substantially flat surface of the first magnet and the substantially flat surface of the second magnet being releasably connectable to each other in the assembled state.

* * * * *